US009925674B2

(12) United States Patent
Scimone et al.

(10) Patent No.: US 9,925,674 B2
(45) **Date of Patent: *Mar. 27, 2018**

(54) POCKET CUTTER

(71) Applicant: Slice, Inc., San Jose, CA (US)

(72) Inventors: Thomas Scimone, Campbell, CA (US); Scott Herbst, San Jose, CA (US); Bruce Allen Eisenhauer, Du Quoin, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/435,757

(22) Filed: Feb. 17, 2017

(65) Prior Publication Data

US 2017/0157784 A1 Jun. 8, 2017

Related U.S. Application Data

(63) Continuation of application No. 14/106,678, filed on Dec. 13, 2013, now Pat. No. 9,579,808.

(60) Provisional application No. 61/739,712, filed on Dec. 19, 2012.

(51) Int. Cl.
*B26B 5/00* (2006.01)

(52) U.S. Cl.
CPC ..... *B26B 5/003* (2013.01)

(58) Field of Classification Search
CPC ..... B26B 5/003; B26B 1/00; B26B 1/08
USPC ..... 30/2, 335, 164, 162
See application file for complete search history.

(56) References Cited

U.S. PATENT DOCUMENTS

| | | | | |
|---|---|---|---|---|
| 2,644,230 | A * | 7/1953 | Anderson | B26B 5/006 30/151 |
| 4,281,458 | A * | 8/1981 | Okada | B26B 1/08 30/162 |
| 6,219,923 | B1 * | 4/2001 | Sinisi | B26B 5/001 30/162 |
| 6,516,520 | B1 * | 2/2003 | Liao | B43M 7/002 30/162 |
| 6,543,140 | B1 * | 4/2003 | Davis | B26B 29/02 30/162 |
| 7,155,829 | B1 * | 1/2007 | Sun | B26B 5/003 30/125 |
| 8,375,588 | B2 * | 2/2013 | Gringer | B26B 5/001 30/154 |
| 8,938,883 | B2 * | 1/2015 | Gringer | B26B 1/048 30/155 |

* cited by examiner

*Primary Examiner* — Omar Flores Sanchez
(74) *Attorney, Agent, or Firm* — James M. Smedley LLC; James Michael Smedley, Esq.

(57) ABSTRACT

The present invention generally relates to a pocket cutter. Specifically, embodiments of the present invention relate to a pocket cutter apparatus with a retractable blade. Embodiments of the pocket cutter apparatus are further comprised of a thumb slider switch.

9 Claims, 8 Drawing Sheets

POCKET CUTTER

CROSS-REFERENCE TO RELATED APPLICATIONS

This application is a continuation of U.S. patent application Ser. No. 14/106,678 filed Dec. 13, 2013 which claims the benefit of U.S. Pat. App. No. No. 61/739,712 filed on Dec. 19, 2012, each of which is hereby incorporated by reference in its entirety.

FIELD OF THE INVENTION

The present invention generally relates to a pocket cutter. Specifically, embodiments of the present invention relate to a pocket cutter apparatus with a retractable blade. Embodiments of the pocket cutter apparatus are further comprised of a thumb slider switch.

BACKGROUND

The pocket cutter is a basic cutting tool that takes on a variety of forms. As the name suggests, a typical pocket cutter is small enough to be carried in the pocket of a user. Additionally, the typical pocket cutter is a compact cutting tool with a folding or otherwise retractable blade. The average pocket cutter requires the user to unfold the blade from the handle or extend the blade with a button or other mechanism in order to lock the blade into place before using the blade. This design feature creates an increase chance of injury, as the blade is left unnecessarily exposed for extended periods of time because many users find it cumbersome and time consuming to securely retract the blade when the pocket cutter is used repeatedly in a short time span.

Current pocket cutters also pose a safety concern in how a user holds the tool. The ergonomics of a standard pocket cutter require a user to wrap their hand completely around the handle of the pocket cutter. This design creates a hazard to the user as the handle can slip through the user's hand and expose the user to the blade of the pocket cutter as it passes through the user's hand. This shortcoming is exacerbated by the fact that the blade of the pocket cutter blade remains extended as it does not automatically retract.

Therefore, there is a need in the art for a pocket cutter that incorporates automatically retracting blade and improved handle ergonomics to reduce the risk of injury. These and other features and advantages of the present invention will be explained and will become obvious to one skilled in the art through the summary of the invention that follows.

SUMMARY OF THE INVENTION

Accordingly, it is an aspect of the present invention to provide a pocket cutter with an automatically retracting blade. Furthermore, it is an aspect of the present invention to provide a compact cutting tool that is capable of making nimble, accurate cuts.

According to an embodiment of the present invention, a pocket cutter includes: a main body housing, including a front-half body shell configured with a switch groove slot, a rear-half body shell, and a blade outlet slot, wherein the blade outlet slot is formed at a front edge of the main body housing from a notch in each of the front-half body shell and the rear-half body shell, a blade carrier retained within the main body housing, wherein the blade carrier is configured to hold a cutting blade, a thumb slider switch configured to pass through the switch groove slot in the front-half body shell and engage with the blade carrier to form a blade control unit that is movable between at least two positions, wherein a first position of the at least two positions is when the thumb slider switch and the blade carrier are in a rear position and the cutting blade is retracted within the main body housing, wherein a second position of the at least two positions is when the thumb slider switch and the blade carrier are in a forward position and the cutting blade is extended from the blade outlet slot, and a tension component configured to connect the blade control unit to an anchor point, wherein the tension component causes the cutting blade to be automatically retracted from the second position to the first position when the thumb slider is not held in the second position.

According to an embodiment of the present invention, the front-half body shell further includes a slider switch groove formed as a depression in an outer wall of the front-half body shell in which the thumb slider switch moves between the first position and the second position.

According to an embodiment of the present invention, the slider switch grove defines a movement limit boundary for the first position and the second position of the thumb slider switch.

According to an embodiment of the present invention, the switch groove slot is formed in the bottom center of the slider switch groove.

According to an embodiment of the present invention, the front-half body shell further includes a blade carrier track that is formed on the interior of the front-half body shell and is adapted to guide the blade carrier within the main body housing.

According to an embodiment of the present invention, the blade carrier further includes a carrier track alignment feature that adapted to guide the blade carrier on the blade carrier track.

According to an embodiment of the present invention, the main body housing further includes a lanyard attachment point.

According to an embodiment of the present invention, the main body housing further includes a front housing engagement means that is adapted to align and connect the front edge of the front-half body section and to the front edge of the rear-half body section.

According to an embodiment of the present invention, the main body housing further includes a rear housing engagement means that is adapted to align and connect the back edge of the front-half body section and to the back edge of the rear-half body section.

According to an embodiment of the present invention, the front-half body shell further includes a blade carrier stop formed on the interior of the front-half body shell that is adapted to stop the blade carrier when it reaches the first position.

According to an embodiment of the present invention, the rear-half body shell further includes a magnet receptacle adapted to retain a magnet.

According to an embodiment of the present invention, the pocket cutter further includes a body housing lock that is adapted to lock the front-half body shell onto the rear-half body shell.

According to an embodiment of the present invention, the rear-half body shell is adapted to retain the body housing lock at a body housing lock aperture formed in the rear-half body shell.

According to an embodiment of the present invention, the body housing lock includes a locking hub that is adapted to reversibly engage with a locking hub connection element on the interior surface of the front-half body shell.

According to an embodiment of the present invention, the body housing lock includes an outer cap configured with an outer cap slot that is adapted to facilitate the operation of the body housing lock.

According to an embodiment of the present invention, the tension component is a spring.

According to an embodiment of the present invention, the blade control unit and the main body housing are configured to lock the blade control unit in the second position so as to cause the cutting blade to remain extended when the thumb slider switch is released.

According to an embodiment of the present invention, the cutting blade is configured to be manually retracted when the blade control unit is manually moved from the second position to the first position.

According to an embodiment of the present invention, the at least two positions correspond to at least two cutting blade positions selected from a group of cutting blade positions comprising a fully retracted cutting blade, a partially extended cutting blade, and fully extended cutting blade.

The foregoing summary of the present invention with the preferred embodiments should not be construed to limit the scope of the invention. It should be understood and obvious to one skilled in the art that the embodiments of the invention thus described may be further modified without departing from the spirit and scope of the invention.

DETAILED SPECIFICATION

Figure 1:
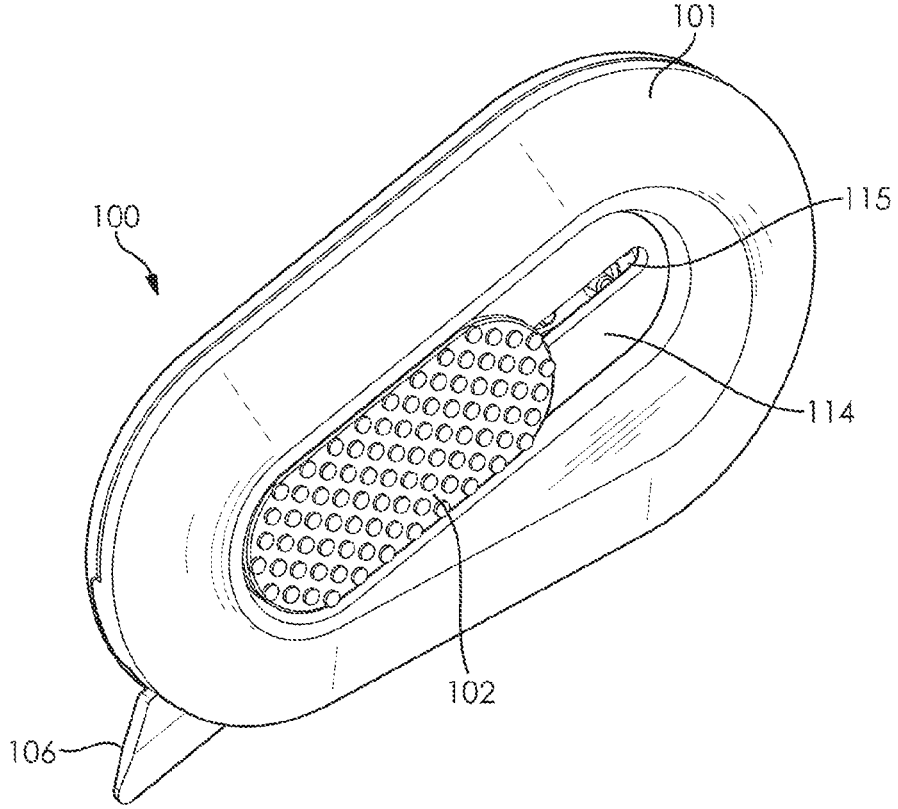
FIG. 1 is a perspective view of a pocket cutter with its blade extended in accordance with an embodiment of the present invention.

The present invention generally relates to a pocket cutter. Specifically, embodiments of the present invention relate to a pocket cutter apparatus with a retractable blade. Embodiments of the pocket cutter apparatus are further comprised of a thumb slider switch.

According to an embodiment of the present invention, the pocket cuter is comprised of a main body housing, a thumb slider switch, a blade carrier, a blade, a spring, a magnet, and a body housing lock. Certain embodiments of the present invention may include fewer components or additional components depending on the utilization and purpose for the pocket cutter.

According to an embodiment of the present invention, the main body housing of the pocket cutter is configured to receive and retain the thumb slider switch, the blade carrier, the blade, the spring, the magnet, and the body housing lock. In a preferred embodiment, the main body housing may be comprised of two corresponding halves, a front-half body shell and a rear-half body shell, that are configured to contain the other components of the pocket cutter. The preferred embodiment of the main body housing may be further comprised of a front housing engagement means and a rear housing engagement means that are configured to align and connect the front-half body shell with the rear-half body shell. Finally, the preferred embodiment of the main body housing may be comprised of a blade outlet slot (at the front edge of the pocket cutter) and a lanyard attachment point (at the rear edge of the pen cutter). In the preferred embodiment, the main body housing may be primarily flat and roughly oval in shape. One of ordinary skill in the art would appreciate that the main body housing could be designed in any number of configurations, and embodiments of the present invention are contemplated for use with any such configuration.

According to an embodiment of the present invention, the main body housing of the pocket cutter is comprised of a front-half body shell. In a preferred embodiment, the front-half body shell is comprised of a slider switch groove, a switch groove slot, a blade carrier stop, and a blade carrier track. In the preferred embodiment, the slider switch groove is formed on the outer surface of the front-half body shell, while the switch groove slot is a void formed in the bottom center of the slider switch groove that creates a passage to the internal portion of the pocket cutter. Additionally, the blade carrier stop and the blade carrier track are formed on the inner surface of the front-half body shell. One of ordinary skill in the art would appreciate that are numerous suitable configurations for the front-half body shell of the pocket cutter, and embodiments of the present invention are contemplated for use with any such configuration.

According to an embodiment of the present invention, the exterior surface of the front-half body shell of the pocket cutter may be configured with a slider switch groove and a switch groove slot. In a preferred embodiment, the slider switch groove is a depression formed in the outer surface of the front-half body shell, while the switch groove slot is an opening in the outer surface of the front-half body shell that is substantially contained within the slider switch groove. In the preferred embodiment, the slider switch groove defines the movement limits of the thumb slider switch, while the slider button slot allows the thumb slider switch to pass through front-half body shell to engage with the blade carrier.

According to an embodiment of the present invention, the interior surface of the front-half body shell may be configured with a blade carrier stop and a blade carrier track. In a preferred embodiment, the blade carrier stop is a protrusion that extends perpendicularly from the inner surface of the front-half body shell, while the blade carrier track is a set of ribs and/or channels on the inner surface of the front-half shell. In the preferred embodiment, the blade carrier stop is adapted to limit the movement range of the blade carrier within the main body housing by defining the boundary of the retracted (or rear) position, while the blade carrier track defines and guides the movement of the blade carrier between a retracted position and an extended position. Finally, the preferred embodiment of the front-half body shell may include multiple blade carrier stops, with one or more blade carrier stops configured at the rear portion of the blade carrier track and a main blade carrier stop configured on the inner surface of the rear middle portion of front-half body shell. The preferred embodiment of the main blade carrier stop may further include a locking hub connection element that is formed at the distal end of the main blade carrier stop and is configured to engage with a corresponding component on the body housing lock.

According to an embodiment of the present invention, the pocket cutter may be configured with a tension component attachment point formed on inner surface of the main body housing. In a preferred embodiment, then tension component attachment point (or anchor point) is one or more protrusions formed on the inner surface of the front-half body shell that are adapted to connect to or otherwise receive the tension component. One of ordinary skill in the art would appreciate that there are many arrangements for a tension component attachment point, and embodiments of the present invention are contemplated for use with any such arrangement.

According to an embodiment of the present invention, the main body housing of the pocket cutter is comprised of a rear-half body shell. In a preferred embodiment, the rear-half body shell is comprised of a body housing lock aperture and a magnet receptacle. In the preferred embodiment, the body housing lock aperture is formed in the wall of the rear-half body shell to allow the body housing lock to pass through the main body housing and engage with the locking hub connection element on the blade carrier stop, while the magnet receptacle is formed on the inner surface of the rear-half body shell and is adapted to receive a magnet. Additionally, the outer surface of the rear-half body shell may further include a lock indicator that is adapted to show when the body housing lock is engaged. One of ordinary skill in the art would appreciate that are numerous suitable configurations for the rear-half body shell of the pocket cutter, and embodiments of the present invention are contemplated for use with any such configuration.

According to an embodiment of the present invention, the main body housing includes a front housing engagement means and a rear housing engagement means. In a preferred embodiment, the front housing engagement means is a pair of corresponding connector elements that configured on the front portion of each of the front-half body shell and the rear-half body shell, that are adapted to connect and align the front portion of main body housing. The front housing engagement means may be configured to connect the front-half body shell to the rear-half body shell in addition to or instead of the body housing lock. In a preferred embodiment, the rear housing engagement means is, similarly, a pair of corresponding connector elements that configured on the rear portion of each of the front-half body shell and the rear-half body shell, that are adapted to connect and align the rear portion of main body housing. The rear housing engagement means may be configured to connect the front-half body shell to the rear-half body shell in addition to or instead of the body housing lock. In the preferred embodiment, the main body housing is separable into two halves to facilitate the replacement of the cutting blade. In an alternate embodiment, however, the main body housing is not separable, and the cutting blade is replaced by extending the cutting blade though the blade outlet slot. One of ordinary skill in the art would appreciate that the each of the housing engagement could be adapted with a number of designs, and embodiments of the present invention are contemplated for use with any suitable design.

According to an embodiment of the present invention, the main body housing is comprised of a blade outlet slot and a lanyard attachment point. In a preferred embodiment, the blade outlet slot is formed on the edge of the front portion of the main body housing. In particular, a notch in the edges of each of the front-half body shell and rear-half body shell collectively form the blade outlet slot when the two halves are connected together. Similarly, in a preferred embodiment, the lanyard attachment point is formed on the edge of the rear portion of the main body housing. In particular, one or more notches in the edges of each of the front-half body shell and rear-half body shell collectively form the lanyard attachment point when the two halves are connected together.

According to an embodiment of the present invention, the pocket cutter may include a body housing lock. In a preferred embodiment, the body housing lock is comprised of an external outer cap and an internal locking hub. In the preferred embodiment, the body housing lock is retained within the body housing lock aperture of the rear-half body shell and is configured to reversibly connect to the locking hub connection element on the blade carrier stop. Specifically, the outer cap is retained within the outer surface of the rear-half body shell and is connected to the locking hub, which is retained on at the inner surface of the rear-half body shell. In the preferred embodiment, when the body housing lock is engaged it causes the rear-half body shell to be securely connected to the front-half body shell and, furthermore, serves as an additional means of securing the blade in the blade carrier. The body housing lock may be engaged with a twist-lock connection, a snap connection, or a screw-type connection. In alternate embodiments, the body housing lock may be comprised of additional or fewer components. One of ordinary skill in the art would appreciate that there are many suitable designs for a body housing lock, and embodiments of the present invention are contemplated for use with any such design.

According to an embodiment of the present invention, the body housing lock is comprised of an outer cap. In a preferred embodiment, the outer cap is substantially disk-shaped component that is adapted to be retained with the wall of the rear-half body shell, such that the outer cap is flush with the outer surface of the rear-half body shell. The outer cap may be further adapted with a slot to assist the user with engaging and disengaging the body housing lock. In the preferred embodiment a user will twist the outer cap, which in turn causes the locking hub to selective engage with the front-half body shell (i.e. via the locking hub connection element on the blade carrier stop).

According to an embodiment of the present invention, the body housing lock is comprised on a locking hub. In a preferred embodiment, the locking hub is a primarily dish-shaped component that is adapted to connect to the outer cap and reversibly engage with the locking hub connection element on the blade carrier stop. In the preferred embodiment, the locking hub may be configured with a series of notches and/or projections that correspond to similar features on the body housing lock aperture to define the movement limits of the body housing lock. More importantly, those notches and/or projections allow the locking hub to receive the locking hub connection element and then for the locking hub to be twisted so that the lip of the locking hub connection element is held firmly under the lip of the locking hub.

According to an embodiment of the present invention, the pocket cutter may include a blade carrier. In a preferred embodiment, the blade carrier may be comprised of a blade holder, a slider switch engagement point, and a carrier track alignment feature. In the preferred embodiment, the blade holder is configured to retain a cutting blade, while the slider switch engagement point is configured to connect to the thumb slider switch. In the preferred embodiment, the carrier track alignment feature may be adapted to engage with the blade carrier track of the main body housing in a way that allows the blade carrier to be aligned to slide forward and backward within the main body housing. One of ordinary skill in the art would appreciate that the blade carrier could be designed with a number of configurations, and embodiments of the present invention are contemplated for use with any such configuration.

According to an embodiment of the present invention, the pocket cutter may include a thumb slider switch. In a preferred embodiment, the thumb slider switch is comprised of an actuator portion and a blade carrier connector post. In a preferred embodiment, the top actuator portion may be generally flat and oval in shape with a textured surface on its front face that is adapted to improve grip between the thumb slider switch and the thumb of a user. Additionally, in the preferred embodiment, the blade carrier connector post extends perpendicularly off the rear of the thumb slider switch and is configured to pass through the switch groove slot and engage with the slider switch engagement point on the blade carrier. The thumb slider switch is further secured to the blade carrier when a portion of the spring engages with an attachment point on the blade carrier connector post (i.e. connector post securing point). In the preferred embodiment, when the thumb slider switch is connected to the blade carrier, the pair collectively forms the blade control unit. One of ordinary skill in the art would appreciate that there are many suitable designs for a thumb slider switch, and embodiments of the present invention are contemplated for use with any such design.

According to an embodiment of the present invention, the blade control unit may be used to extend and retract the cutting blade of the pocket cutter. In particular, when the thumb slider switch connects with the blade carrier to form the blade control unit, the thumb slider switch may then be used to slide the blade carrier forward and backward within the main body housing, consequently causing the blade to extend and retract, respectively. In a preferred embodiment, a user will push the thumb slider switch forward, thereby causing the blade carrier within the main body housing of the pocket cutter to be moved forward. With the blade carrier in the forward position, the blade will then be in an extended position through the blade outlet slot of the pocket cutter. When the thumb slider switch is released or otherwise returned to the rear or retracted position, the blade carrier will likewise be returned to the retracted position causing the blade to be returned to the inside of the main body section of the pocket cutter.

According to an embodiment of the present invention, the pocket cutter may include a tension component. In a preferred embodiment, the tension component is a spring and is adapted to facilitate the retraction and extension of the cutting blade. In the preferred embodiment, the tension component attaches to tension component attachment point on the main body housing and the connector post securing point on the blade carrier connector post. In alternate embodiments, the tension component may be an elastic component or other resilient connector. One of ordinary skill in art would appreciate that there are numerous types and configurations for a tension component, and embodiments of the present invention are contemplated for use with any such tension component.

According to an embodiment of the present invention, the pocket cutter has an auto-retracting blade. In a preferred embodiment, the blade of the pen cutter can be extended by sliding a thumb slider switch forward. Applying forward pressure to the thumb slider switch causes creates compression or tension (distortion from the neutral state) in a spring or other tension component that is connectively linked to the blade of the pen cutter via the blade carrier. When the thumb slider switch is released, the compression (or tension) in the spring (or other tension component) causes the blade of the pocket cutter to be retracted as the spring returns to its unbiased or neutral state. One of ordinary skill in the art would appreciate that there are many methods to creating an automatically retracting blade, and embodiments of the present invention are contemplated for use with any such method.

According to an embodiment of the present invention, the pocket cutter has a manually retracting blade. In a preferred embodiment, the blade of the pocket cutter can be extended by pushing a thumb slider switch forward, as the thumb slider switch is connectively linked to the blade via the blade carrier. In one embodiment, the blade can be incrementally extended to cut through materials of varying thicknesses. Accordingly, the thumb slider switch may function in a ratchet-like fashion to lock at multiple positions that correspond to the varying extension of the blade. To extend or retract the blade, the thumb slider switch would be depressed and moved to the appropriate position. Once the blade is extended or retracted to the appropriate position, the thumb slider switch could then be released and the blade would be locked into that position. In an alternate embodiment, the thumb slider switch may be lockable in a forward position so as to cause the blade to remain extended despite pressure from a tension component. In said embodiment, when the thumb slider switch is released from the locked position, the blade will be automatically retracted within the main body section of the pocket butter. The blade may be locked in the forward position by any suitable locking means including, but not limited to, a friction fit, a latching mechanism, or a ratcheting mechanism.

According to an embodiment of the present invention, the pocket cutter may include a magnet. In a preferred embodiment, the magnet is secured to the magnet receptacle that is formed on the inner surface of the rear-half body shell. The magnet may be useful for any variety of tasks, including, but not limited to, holding or securing replacement blades, securing or storing the pocket cutter on magnetic surface, or picking up small magnetic objects, such as nails, screws, or other intricate objects.

According to an embodiment of the present invention, the pocket cutter may include a blade. In a preferred embodiment, the blade may be removable engaged with the blade carrier. The blade may be made from any suitable material, including, but not limited to, metal, ceramic, or any combination thereof. One of ordinary skill in the art would appreciate that there are numerous configurations and materials that might be used for the blade, and embodiments of the present invention are contemplated for use with any such material or configuration.

According to an embodiment of the present invention, the blade that is used may be constructed from a ceramic material that is capable of withstanding extended use without becoming dull or unusable. Ceramic materials appropriate for such construction include, but are not limited to, Zirconium Oxide. One of ordinary skill in the art would appreciate that there are numerous ceramic materials that could be utilized with embodiments of the present invention.

According to an embodiment of the present invention, the blades used in the pocket cutter may contain rounded tips to reduce the chance of injury.

Turning now to FIG. 1, a perspective view of a pocket cutter, in accordance with an embodiment of the present invention. In a preferred embodiment, the pocket cutter 100 is comprised of a main body housing 101, a thumb slider switch 102, a blade carrier (not shown), a body housing lock (not shown), a spring (not shown), a blade 106, and a magnet (not shown). In this view, the thumb slider switch 102 can be seen resting in the slider switch groove 114.

Figure 2:
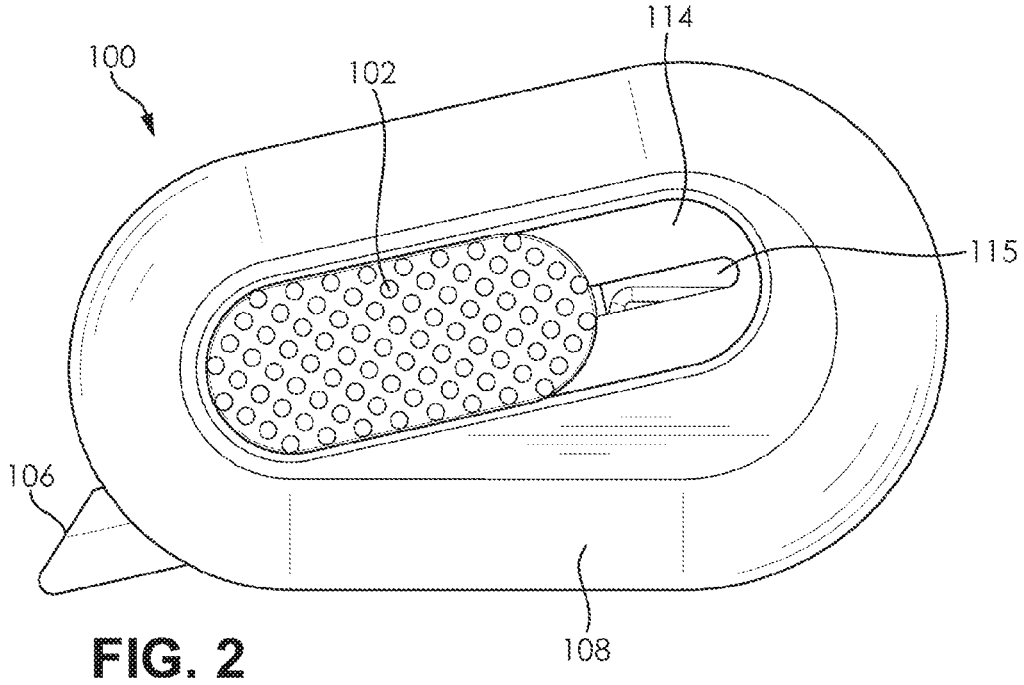
FIG. 2 is front side view of a pocket cutter with its blade extended in accordance with an embodiment of the present invention.

Turning now to FIG. 2, a front side view of a pocket cutter, in accordance with an embodiment of the present invention. In a preferred embodiment, the pocket cutter 100 is comprised of a main body housing, a thumb slider switch 102, a blade carrier (not shown), a body housing lock (not shown), a spring (not shown), a blade 106, and a magnet (not shown). In this view, the thumb slider switch 102 can be seen in a forward position in the slider switch groove 114 that is located on the front-half body shell 108. When the thumb slider switch 102 is in the forward position, the blade 106 is extended.

Figure 3:
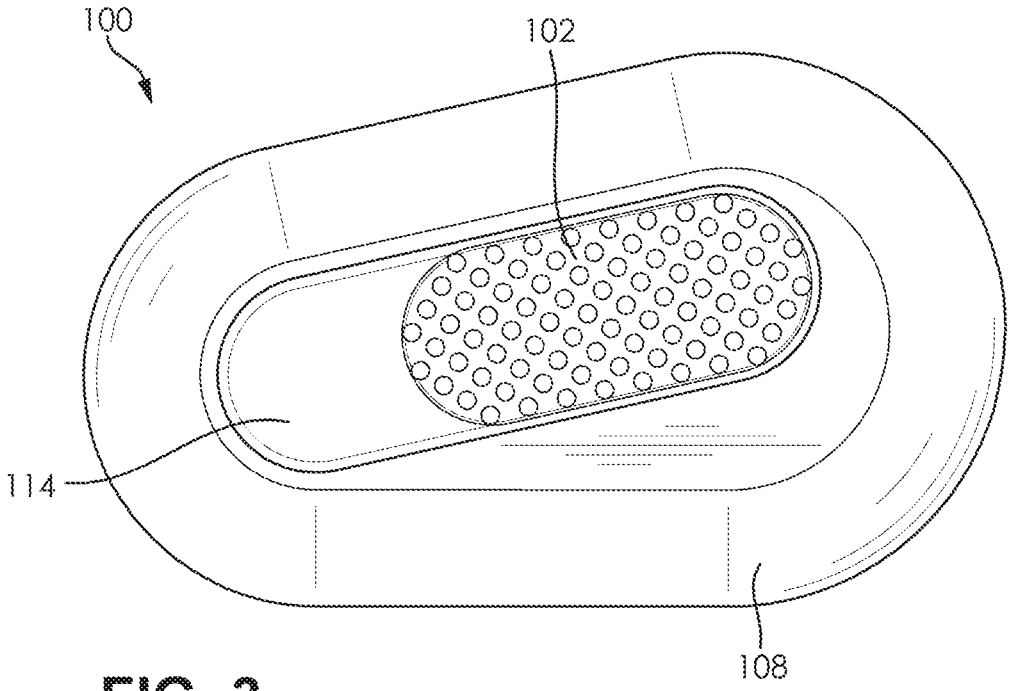
FIG. 3 is a front side view of a pocket cutter with its blade retracted in accordance with an embodiment of the present invention.

Turning now to FIG. 3, a front side view of a pocket cutter, in accordance with an embodiment of the present invention. In a preferred embodiment, the pocket cutter 100 is comprised of a main body housing, a thumb slider switch 102, a blade carrier (not shown), a body housing lock (not shown), a spring (not shown), a blade (not shown), and a magnet (not shown). In this view, the thumb slider switch 102 can be seen in a rear position in the slider switch groove 114 that is located on the front-half body shell 108. When the thumb slider switch 102 is in the rear position, the blade (not shown) is extended.

Figure 4:
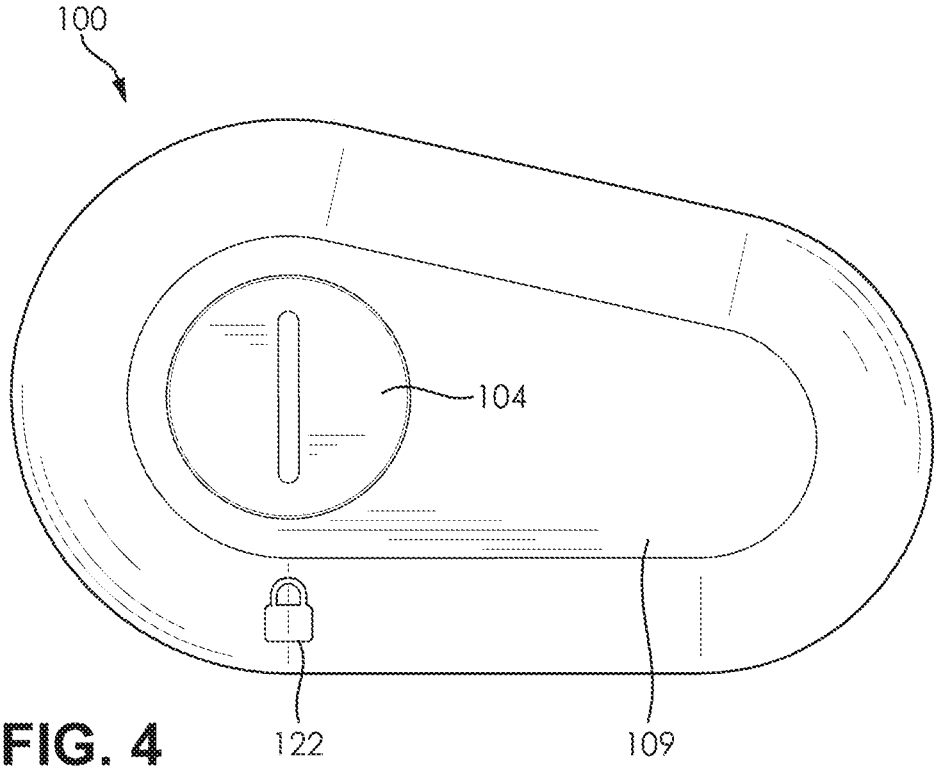
FIG. 4 is a rear side view of a pocket cutter with its blade retracted in accordance with an embodiment of the present invention.

Turning now to FIG. 4, a rear side view of a pocket cutter, in accordance with an embodiment of the present invention. In a preferred embodiment, the pocket cutter 100 is comprised of a main body housing, a thumb slider switch (not shown), a blade carrier (not shown), a body housing lock 104, a spring (not shown), a blade (not shown), and a magnet (not shown). In this view, the body housing lock 104, which is located on the rear-half body shell 109, can be seen in the locked position, with the slot of the locking cap 104 pointing at the lock indicator 122.

Figure 5:
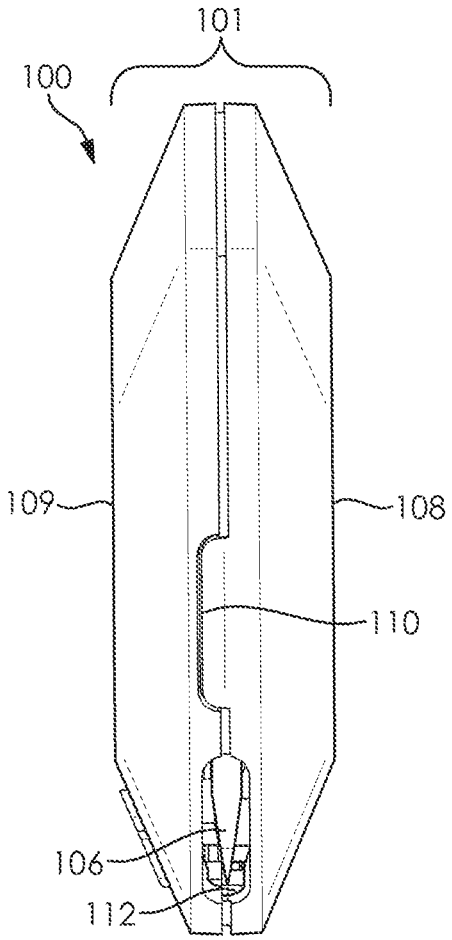
FIG. 5 is a front view of a pocket cutter in accordance with an embodiment of the present invention.

Turning now to FIG. 5, a front view of a pocket cutter, in accordance with an embodiment of the present invention. In a preferred embodiment, the pocket cutter 100 is comprised of a main body housing 101. In the preferred embodiment, the main body housing 101 is comprised of a front-half body shell 108 and a rear-half body shell 109. The front portions of the front-half body shell 108 and a rear-half body shell 109 are connected through the front housing engagement means 110. The front of the main body housing 101 is also configured with a blade outlet slot 112 through which the cutting blade 106 extends.

Figure 6:
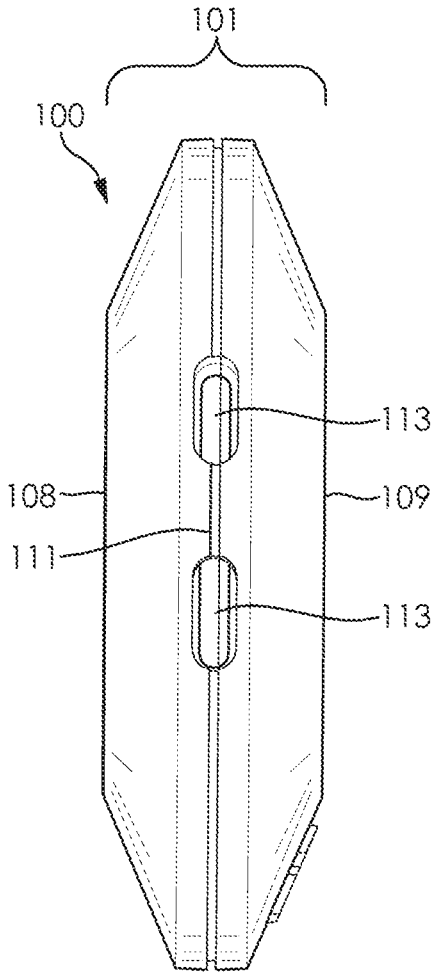
FIG. 6 is a rear view of a pocket cutter in accordance with an embodiment of the present invention.

Turning now to FIG. 6, a rear view of a pocket cutter, in accordance with an embodiment of the present invention. In a preferred embodiment, the pocket cutter 100 is comprised of a main body housing 101. In the preferred embodiment, the main body housing 101 is comprised of a front-half body shell 108 and a rear-half body shell 109. The rear portions of the front-half body shell 108 and a rear-half body shell 109 are connected through the rear housing engagement means 111. The front of the main body housing 101 is also configured with lanyard attachment point 113.

Figure 7:
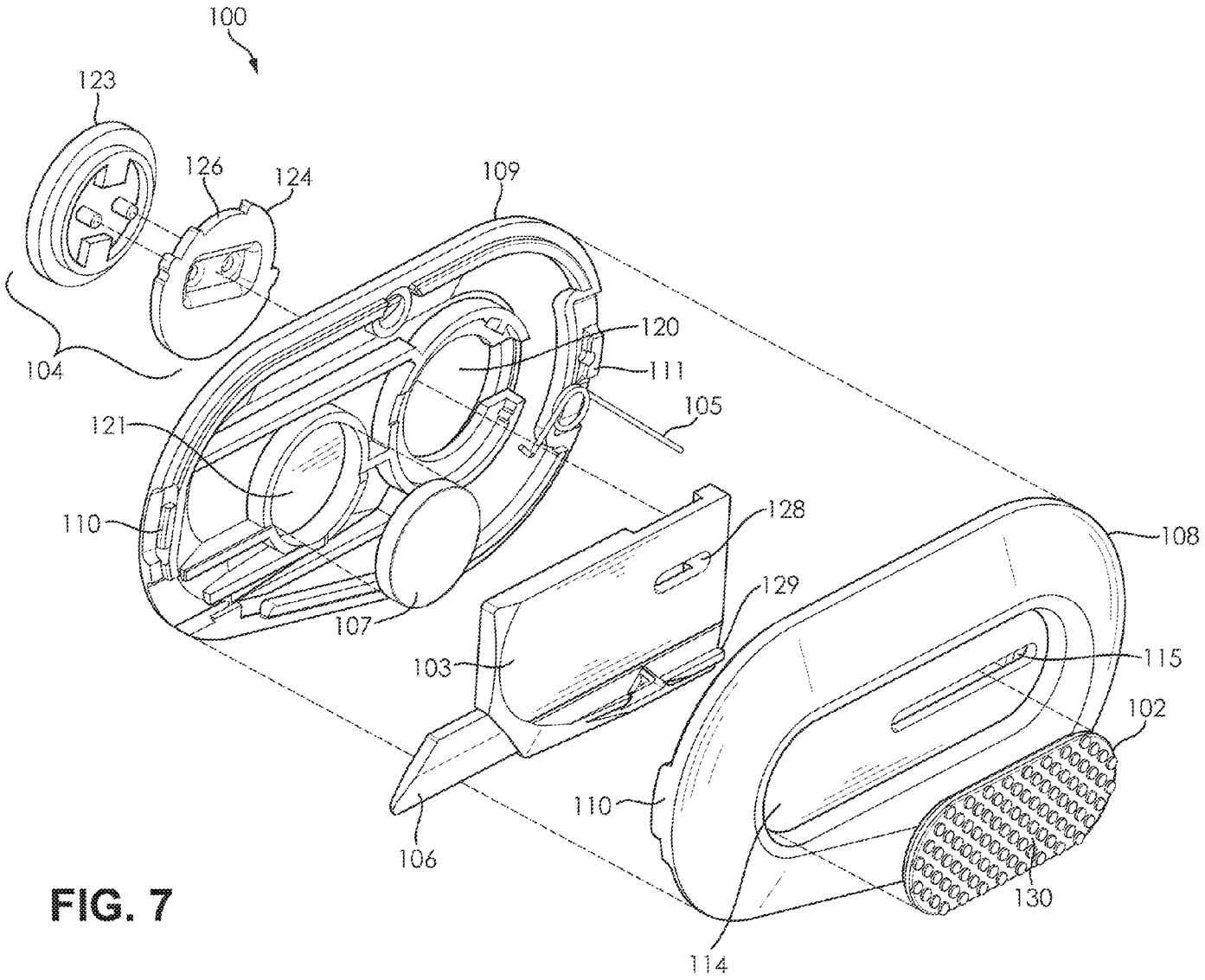
FIG. 7 is an exploded view of a pocket cutter in accordance with an embodiment of the present invention.

Turning now to FIG. 7, a front exploded view of a pocket cutter, in accordance with an embodiment of the present invention. In a preferred embodiment, the main components that comprise the pocket cutter 100 are a main body housing, a thumb slider switch 102, a blade carrier 103, a body housing lock 104, a spring 105, a blade 106, and a magnet 107. The main body housing is comprised of a the main body housing 101, which substantially contains the other components, is comprised of a front-half body shell 108 and a rear-half body shell 109 which are joined to each other through a combination of the body housing lock 104, the front housing engagement means 110, and the rear housing engagement means 111. The body housing lock 104, is comprised of an outer cap 123 and a locking hub 124. The rear-half body shell 109 is adapted to retain the body housing lock 104 at the body housing lock aperture 120 and the magnet 107 at the magnet receptacle 121. The front-half body shell 108 is configured with a slider switch groove 114 where the thumb slider switch 102 rests and a switch groove slot 115 through which the thumb slider switch 102 passes to engage with the slider switch engagement point 128 on the blade carrier 103. The thumb slider switch 102 is further configured with a textured actuator portion 130 that provides a user to main a firm grip on the thumb slider switch 102. The blade carrier 103 is further configured with a carrier track alignment feature 129 that is configured to guide the blade carrier 103 on the blade carrier track (not shown).

Figure 8:
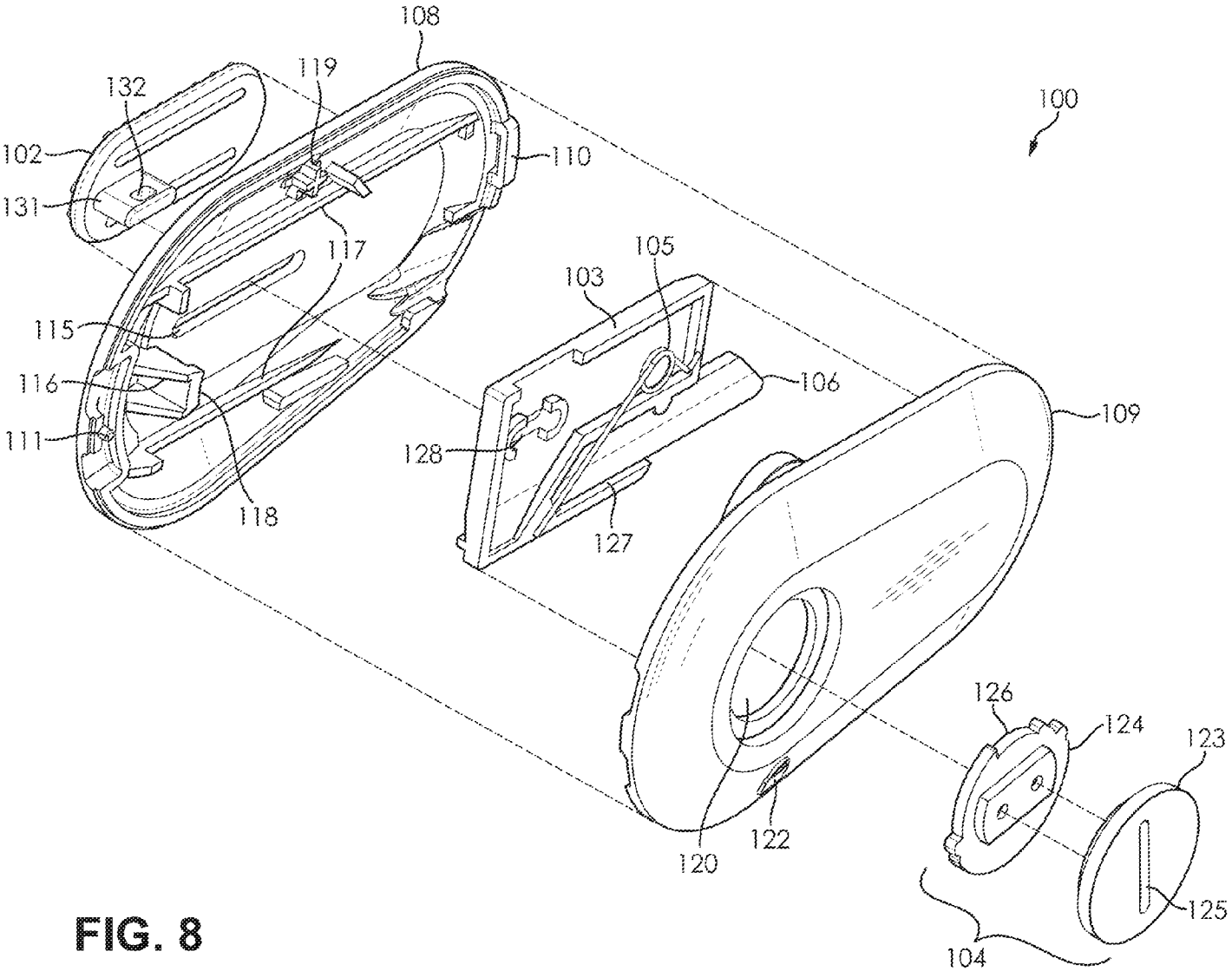
FIG. 8 is an alternate exploded view of a pocket cutter in accordance with an embodiment of the present invention.

Turning now to FIG. 8, a rear exploded view of a pocket cutter, in accordance with an embodiment of the present invention. In a preferred embodiment, the main components that comprise the pocket cutter 100 are a main body housing, a thumb slider switch 102, a blade carrier 103, a body housing lock 104, a spring 105, a blade 106, and a magnet 107. The main body housing is comprised of a the main body housing 101, which substantially contains the other components, is comprised of a front-half body shell 108 and a rear-half body shell 109 which are joined to each other through a combination of the body housing lock 104, the front housing engagement means 110, and the rear housing engagement means 111. The body housing lock 104, is comprised of an outer cap 123 and a locking hub 124. The front-half body shell 108 is configured with a switch groove slot 115 through which the blade carrier connector post 131 of the thumb slider switch 102 passes to engage with the slider switch engagement point 128 on the blade carrier 103. Once passing through the slider switch engagement point 128, the thumb slider switch 102 is secured in place when the long arm of the spring 105 passes through the connector post attachment point 132 on the blade carrier connector post 131 (See also FIG. 11). The front-half body shell 108 is further adapted with a blade carrier stop 116, a blade carrier track 117, a locking hub connection element 118, and a tension component attachment point 119. In the preferred embodiment, the locking hub connection element 118 is configured at the distal end of the blade carrier stop 116. The locking hub connection element 118 is configured to interact with the locking hub 124 of the body housing lock 104. The blade carrier track 117 is adapted to cooperate with the carrier track alignment feature (not shown) to properly guide the blade carrier 103. The blade carrier 103 is further configured with a blade holder 127 adapted to secure the cutting blade 106. The rear-half body shell 109 is adapted to retain the body housing lock 104 at the body housing lock aperture 120 and is further configured with a lock indicator 122 to indicate when the status of the body housing lock 104 (i.e. locked or unlocked).

Figure 9:
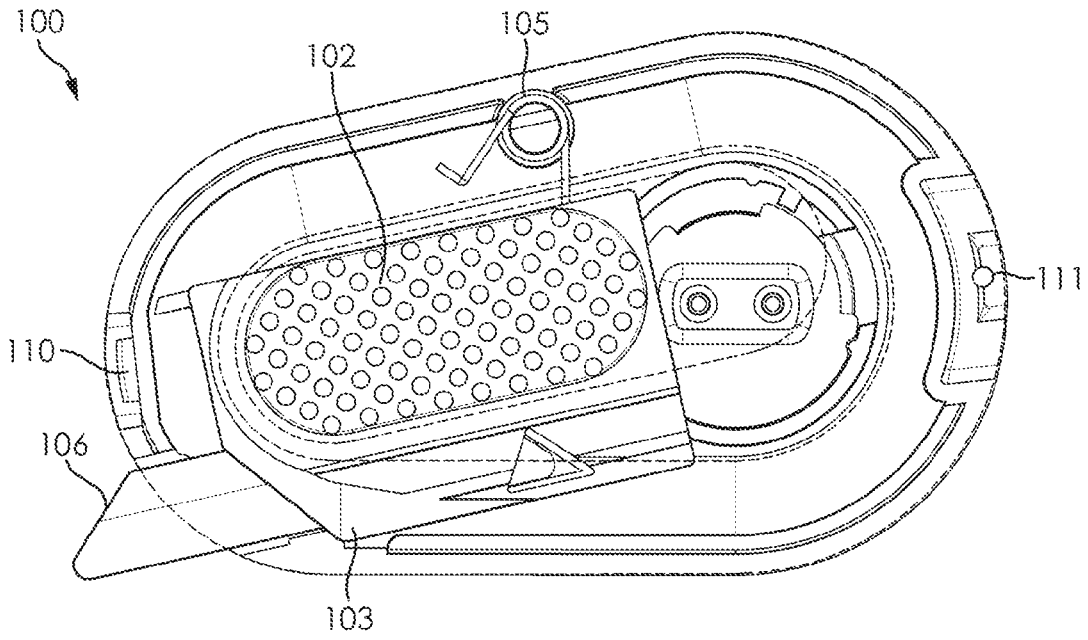
FIG. 9 is front side view of a pocket cutter where the front-half of the body housing is transparent and its blade is extended in accordance with an embodiment of the present invention.

Turning now to FIG. 9, a front side view of a pocket cutter with a transparent front-half body shell, in accordance with an embodiment of the present invention. In a preferred embodiment, the pocket cutter 100 features an automatically retracting blade. In the preferred embodiment, when the slider button 102 is moved to the forward position, the blade carrier 103 is moved forward (and therefore the blade 106 is extended) and the spring 105 is compressed. As long a user maintains forward pressure on the slider button 102, the blade 106 will remain extended against the tension of the spring 105. When the slider button 102 is released, the tension in the spring 105 causes the blade carrier 103 and the cutting blade 106 to be automatically retracted.

Figure 10:
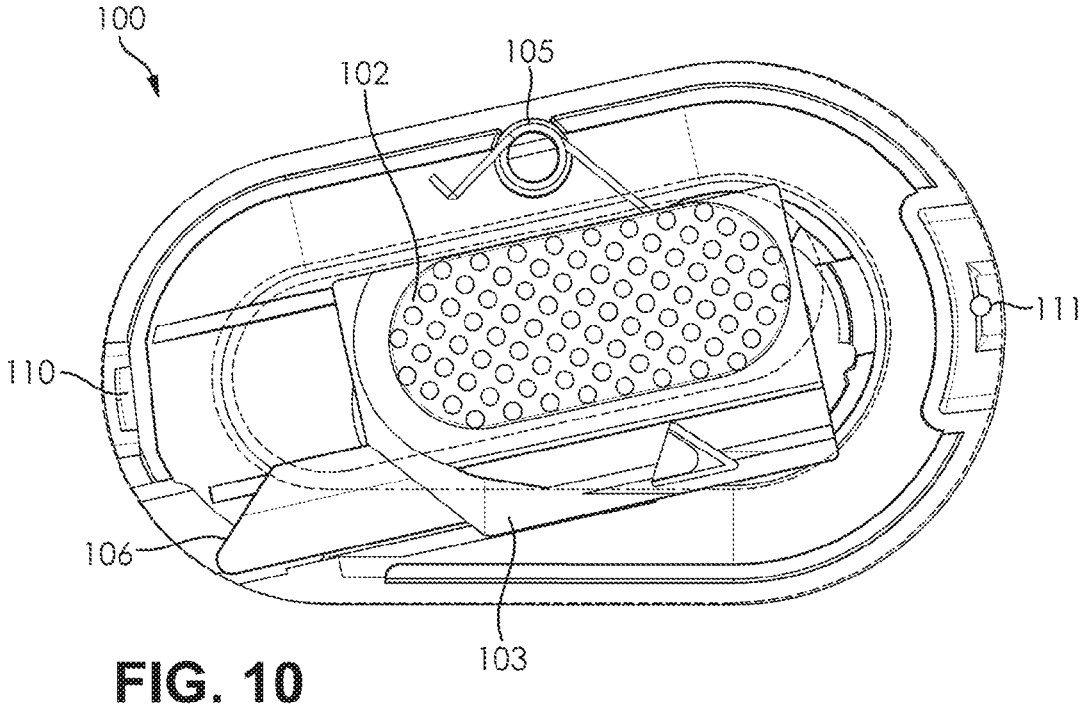
FIG. 10 is front side view of a pocket cutter where the front-half of the body housing is transparent and its blade is retracted in accordance with an embodiment of the present invention.

Turning now to FIG. 10, a front side view of a pocket cutter with a transparent front-half body shell, in accordance with an embodiment of the present invention. In a preferred embodiment, the pocket cutter 100 features an automatically retracting blade. In the preferred embodiment, when the slider button 102 is in the rear position, the blade carrier 103 is also in the rear position (and therefore the blade 106 is retracted) and the spring 105 is relaxed.

Figure 11:
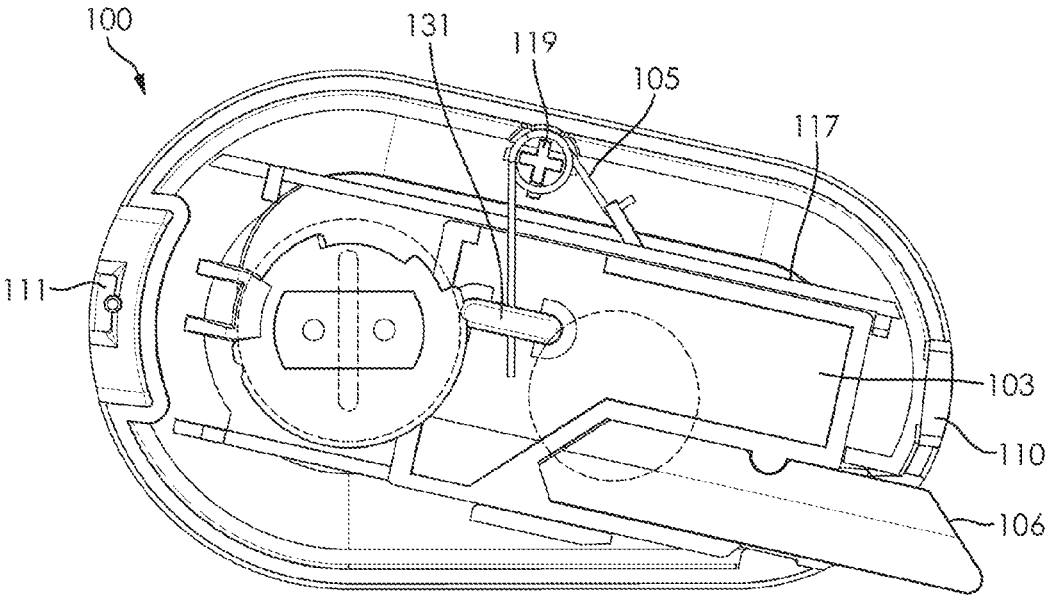
FIG. 11 is rear side view of a pocket cutter where the rear-half of the body housing is transparent and its blade is extended in accordance with an embodiment of the present invention.

Turning now to FIG. 11, a rear side view of a pocket cutter with a transparent rear-half body shell, in accordance with an embodiment of the present invention. In a preferred embodiment, the pocket cutter 100 features an automatically retracting blade. In the preferred embodiment, when the slider button (not shown) is in the rear position, the blade carrier 103 is also in the rear position (and therefore the blade 106 is retracted) and the spring 105 is relaxed. Additionally, in this view (along with FIG. 12), in can be clearly seen how the blade carrier track 117 guides the blade carrier 103. Finally, this view also shows how, in the preferred embodiment, the spring 105 is attached to the tension component attachment 119 on the front-half body shell and then to the connector post securing point (not shown) on the blade carrier connector post 131 of the thumb slider switch.

Figure 12:
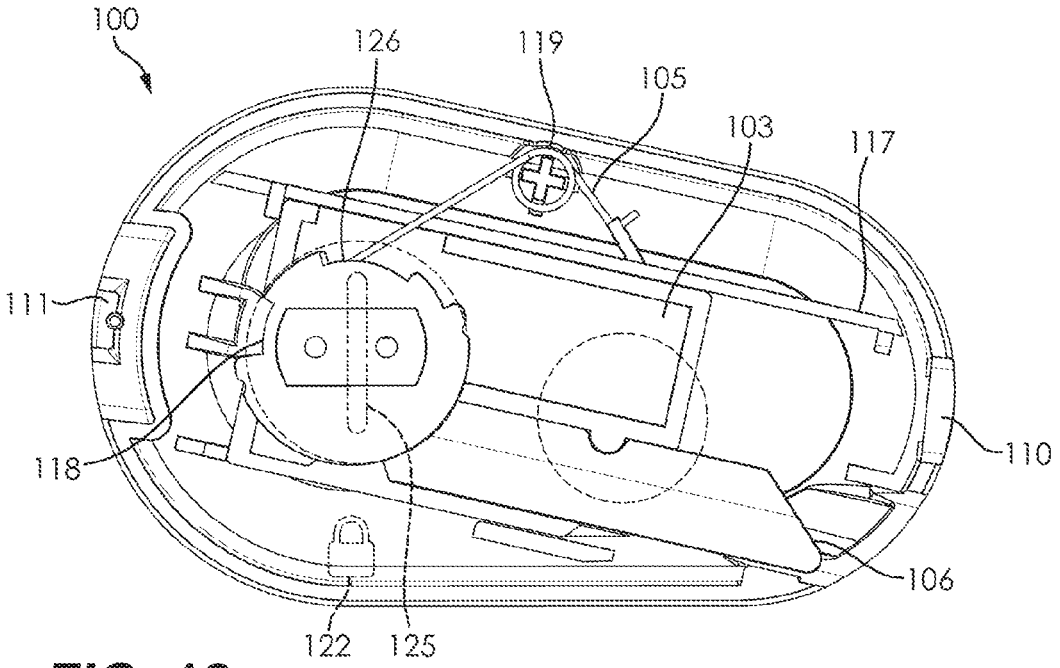
FIG. 12 is rear side view of a pocket cutter where the rear-half of the body housing is transparent and its blade is retracted in accordance with an embodiment of the present invention.

Turning now to FIG. 12, a rear side view of a pocket cutter with a transparent rear-half body shell, in accordance with an embodiment of the present invention. In a preferred embodiment, the pocket cutter 100 features an automatically retracting blade. In the preferred embodiment, when the slider button 102 is moved to the forward position, the blade carrier 103 is moved forward (and therefore the blade 106 is extended) and the spring 105 is compressed. As long a user maintains forward pressure on the slider button 102, the blade 106 will remain extended against the tension of the spring 105. When the slider button 102 is released, the tension in the spring 105 causes the blade carrier 103 and the cutting blade 106 to be automatically retracted. Additionally, in this view (along with FIG. 11), in can be clearly seen how the blade carrier track 117 guides the blade carrier 103. Finally, this view also demonstrates how the body housing lock functions. In a preferred embodiment, the front-half body shell is locked together with the rear-half body shell when the locking hub engagement element 118 is held behind the locking hub. The status of the body housing lock being firmly secured is confirmed by the fact that the outer cap slot 125 is aligned with the lock indicator 122.

Figure 13:
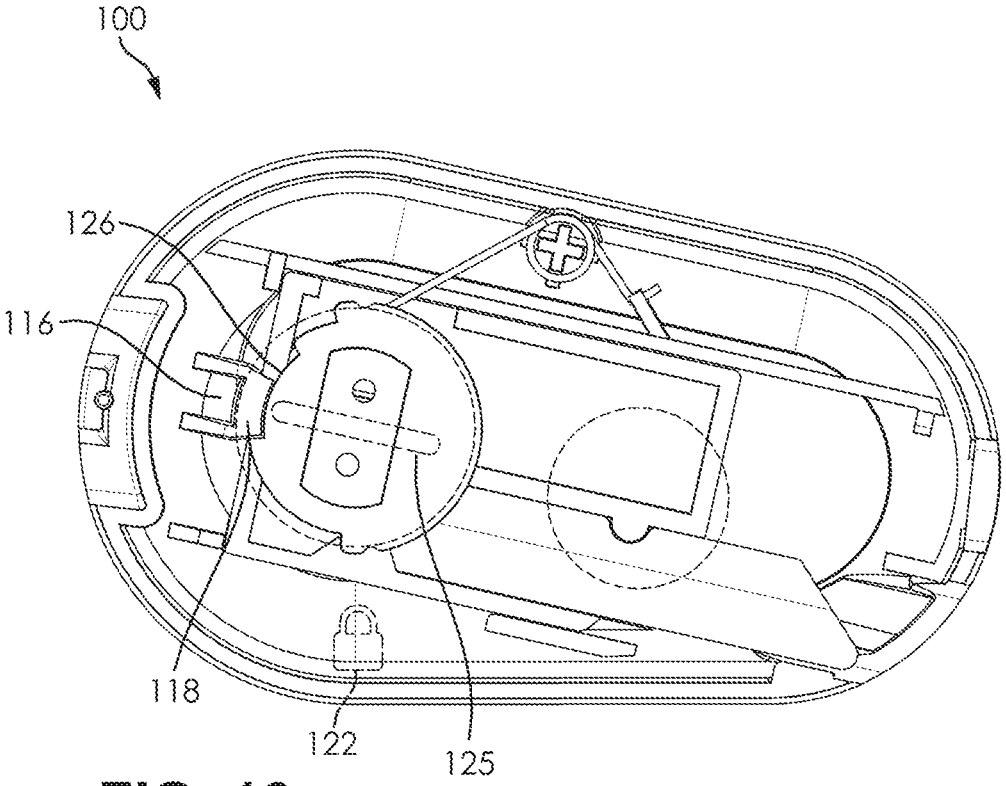
FIG. 13 is rear side view of a pocket cutter where the rear-half of the body housing is transparent and the body housing lock is unlocked in accordance with an embodiment of the present invention.

Turning now to FIG. 13, a rear side view of a pocket cutter with a transparent rear-half body shell, in accordance with an embodiment of the present invention. In a preferred, the pocket cutter 100 is configured with a body housing lock that secures the front-half body shell together with the rear-half body shell. In a preferred embodiment, the front-half body shell is unlocked from the rear-half body shell when the locking hub engagement element 118 is released (or no longer blocked by) the locking hub. In a preferred embodiment, the body housing lock is rotated so that the locking hub is in a position where the locking hub notch 126 is centered on the locking hub engagement element 118. This positioning of the locking hub notch 126 allows the locking hub engagement element 118 move freely past the locking hub of the body housing lock, therefore allowing the front-half body shell and the rear-half body shell to be separated. The status of the body housing lock being unlocked is confirmed by the fact that the outer cap slot 125 is no longer aligned with the lock indicator 122.

It should be noted that the features illustrated in the drawings are not necessarily drawn to scale, and features of one embodiment may be employed with other embodiments as the skilled artisan would recognize, even if not explicitly stated herein. Descriptions of well-known components and processing techniques may be omitted so as to not unnecessarily obscure the embodiments.

While multiple embodiments are disclosed, still other embodiments of the present invention will become apparent to those skilled in the art from this detailed description. The invention is capable of myriad modifications in various obvious aspects, all without departing from the spirit and scope of the present invention. Accordingly, the drawings and descriptions are to be regarded as illustrative in nature and not restrictive.

The invention claimed is:

1. A blade actuation control unit for use in pocket cutter, the blade actuation control unit comprising:

a slider button connected to a blade carrier by a connector post, wherein said slider button is configured to move said blade carrier transversely along a transverse groove of a housing;

wherein said connector post includes an aperture and wherein said connector post extends through said transverse groove of said housing and through a slot in said blade carrier such that said aperture extends beyond said blade carrier slot to an interior side of said blade carrier; and a tension component, wherein said tension component includes a short arm and a long arm, wherein said long arm extends through the connector post aperture on said interior side of said blade carrier.

2. The blade actuation control unit of claim 1, wherein said tension component is mounted to a wall of said housing.

3. The blade actuation control unit of claim 1, wherein said housing includes a slider button groove that defines a movement limit boundary for said slider button.

4. The blade actuation control unit of claim 1, wherein said housing includes a blade carrier track formed on an interior of said housing and is adapted to guide said blade carrier within said housing.

5. The blade actuation control unit of claim 4, wherein said blade carrier includes a carrier track alignment feature adapted to guide said blade carrier on said blade carrier track.

6. The blade actuation control unit of claim 1, wherein said blade carrier is formed with a depression that is configured to retain a cutting blade.

7. The blade actuation control unit of claim 1, further comprising a body housing lock.

8. The blade actuation control unit of claim 7, wherein said housing comprises a front-half body shell and a rear-half body shell joined together to form said housing, wherein said front-half body shell and rear-half body shell may be separated when said body housing lock is in an unlocked position.

9. The blade actuation control unit of claim 1, further comprising:

a blade carrier stop that extends from an inner surface of said housing and is adapted to limit the movement range of the blade carrier within the housing, said blade carrier stop comprising a lip portion; and a body housing lock comprising an outer cap and a locking hub coaxially connected thereto, said outer cap defining a single linear slot configured to receive a flat member used to rotate the body housing lock into an unlocked position in which the housing can be opened and a locked position in which the housing cannot be opened, wherein said locked position is achieved by rotating the locking hub until said lip portion of said blade carrier stop is held behind a peripheral edge of the locking hub and said unlocked position is achieved by rotating the locking hub until a notch in said locking hub overlaps said lip portion.

* * * * *